United States Patent [19]

Krieger

[11] Patent Number: 4,583,936

[45] Date of Patent: Apr. 22, 1986

[54] FREQUENCY MODULATED BURNER SYSTEM

[75] Inventor: David A. Krieger, Toledo, Ohio

[73] Assignee: Gas Research Institute, Chicago, Ill.

[21] Appl. No.: 507,539

[22] Filed: Jun. 24, 1983

[51] Int. Cl.[4] ..... F23C 11/04

[52] U.S. Cl. ..... 431/1; 431/12; 431/60; 431/11; 431/18; 431/75; 236/15 BD; 236/15 BG; 432/25

[58] Field of Search ..... 431/1, 10, 11, 12, 18, 431/60, 62, 78, 80, 164, 174, 215, 42, 75; 236/1 A, 15 BD, 15 BE, 15 BG; 432/25; 122/24; 60/39.76, 247

[56] References Cited

U.S. PATENT DOCUMENTS

| | | | |
|---|---|---|---|
| 2,991,832 | 7/1961 | Dailey | 236/15 BD |
| 3,233,650 | 2/1966 | Cleall | 431/1 |
| 3,969,069 | 7/1976 | Knaak | 236/1 ER X |
| 3,971,344 | 7/1976 | Gouyou-Beauchamps | 431/75 X |
| 4,276,857 | 7/1981 | Martin | 431/1 X |
| 4,314,444 | 2/1982 | Putnam et al. | 60/39.77 |
| 4,415,328 | 11/1983 | Grunden et al. | 431/1 |
| 4,439,137 | 3/1984 | Suzuki et al. | 431/10 X |

FOREIGN PATENT DOCUMENTS

| | | | |
|---|---|---|---|
| 0036567 | 9/1981 | European Pat. Off. | 126/351 |

*Primary Examiner*—Margaret A. Focarino
*Attorney, Agent, or Firm*—H. Duane Switzer

[57] ABSTRACT

A furnace (A) defines a combustion chamber (10) in which a pair of burners (B) are mounted for oxidizing the fuel to heat the combustion chamber. An air blower (12) supplies air to the burners at a rate controlled by a rate control valve (18). A frequency modulated burner control system (C) controls the duty cycle of the burners, i.e. cyclically actuates the burner at a fixed burn rate and then deactuates them. The burner control system varies the actuation to deactuation ratio in each cycle to vary the thermal input to the combustion chamber. The burners provide two - stage combustion wherein a fuel rich mixture is partially oxidized in a first stage combustion area (44). Additional air which is thereafter introduced through air passages (50, 52) completes the combustion.

19 Claims, 11 Drawing Figures

FREQUENCY MODULATED BURNER SYSTEM

BACKGROUND OF THE INVENTION

The present invention relates to the art of combustion methods and apparatus. The invention finds particular application in conjunction with furnaces and will be described with reference thereto. It is to be appreciated, however, that the invention is equally applicable to many combustion installations including boilers, kilns, and other heating apparatus.

Heretofore, industrial furnaces have included a combustion chamber in which a plurality of burners were located. Amplitude modulated control systems were utilized to control the temperature within the combustion chamber. Specifically, a controller would sense the temperature within the combustion chamber, compare the sensed temperature with a selected temperature, and control the amount of fuel and air supplied to the burners. In this manner, the burners combusted fuel at a varied rate to maintain or reach a selected temperature.

One of the problems with the amplitude modulated furnace systems is that they are relatively fuel inefficient. Physical attributes and limitations of the prior art burners caused them to obtain a peak combustion efficiency at a specific or small range of air-to-fuel ratios. When the burners combust fuel either more or less rapidly than the peak efficiency air/fuel ratio, they operate with relatively less fuel efficiency. Further, it is difficult to maintain a stoichiometrically balanced air/fuel ratio over a wide range of air and fuel supply rates. Another problem with the amplitude modulated burner systems has been that at reduced heats, they have relatively low conductive heat transfer characteristics. Particularly, the heated gases have less momentum at lower temperature settings, i.e., at lower combustion rates. Further, the burners are frequently unable to maintain stable flames over a wide range of heating rates.

In accordance with the present invention, a frequency modulated control system with two-stage burners for combustion apparatus is provided to overcome the above-referenced problems and others, yet reliably maintain an accurate temperature control with high fuel efficiency.

SUMMARY OF THE INVENTION

In accordance with the present invention, a combustion apparatus is provided including a combustion chamber, at least one burner, and a frequency modulated burner control system. The frequency modulated burner control system cyclically actuates the burner at a preselected, fixed combustion rate and deactuates the burner for selectively adjustable portions of each cycle. In this manner, the control system controls the combustion chamber temperature by controlling the duty cycle of the burner, i.e., the burner actuation to deactuation ratio in each cycle.

In accordance with another aspect of the present invention, there is provided a method of combusting fuel. Fuel and air are supplied to a burner. The burner is cyclically actuated to combust fuel at a preselected rate and then deactuated. A duty cycle at which the burner is actuated at the fixed combustion rate is selectively varied to vary the amount of heat produced.

In accordance with a more limited aspect of the invention, the combustion chamber includes a plurality of burners. A synchronization means is provided for synchronizing the actuation of the burners in a staged manner.

In accordance with still another aspect of the invention, each burner includes a first stage combustion area for partially combusting a fuel rich air/fuel mixture, and a second stage combustion area downstream from the first stage combustion area for completing combustion.

In accordance with yet another aspect of the present invention, an automatic air/fuel ratio adjustment is advantageously provided. The air/fuel ratio adjustment is effected by an override means for periodically overriding the burner control means to cause the burner to be actuated for a calibration duration without regard to the combustion chamber temperature. During the calibration duration, air flow measuring means measures the air flow to the burner, and air flow comparing means compares the measured air supply rate with an optimal air supply rate. Under the control of the air flow comparing means, the rate at which air is supplied is selectively adjusted.

A primary advantage of the present invention is the conversion of fuel into heat energy with a high degree of efficiency over a wide range of thermal input rates.

Another advantage of the subject new frequency modulated combustion system resides in the provision of a wide range of selectable thermal inputs, i.e., a large turndown ratio.

Still another advantage of the invention is that the burners maintain a stable flame over a wide range of thermal input rates.

Still further advantages of the invention include providing a higher burn momentum, achieving temperatures greater than 1200° F. in the combustion chamber, and reducing the formation of nitrogen oxides.

Further advantages of the present invention will become apparent to those skilled in the art upon a reading and understanding of the following detailed description of the preferred embodiment.

BRIEF DESCRIPTION OF THE DRAWINGS

The invention may take form in various parts and arrangements of parts and in various steps and arrangements of steps, a preferred embodiment of which will be described in detail in this specification and illustrated in the accompanying drawings which form a part hereof.

DETAILED DESCRIPTION OF THE PREFERRED EMBODIMENT

Figure 1:
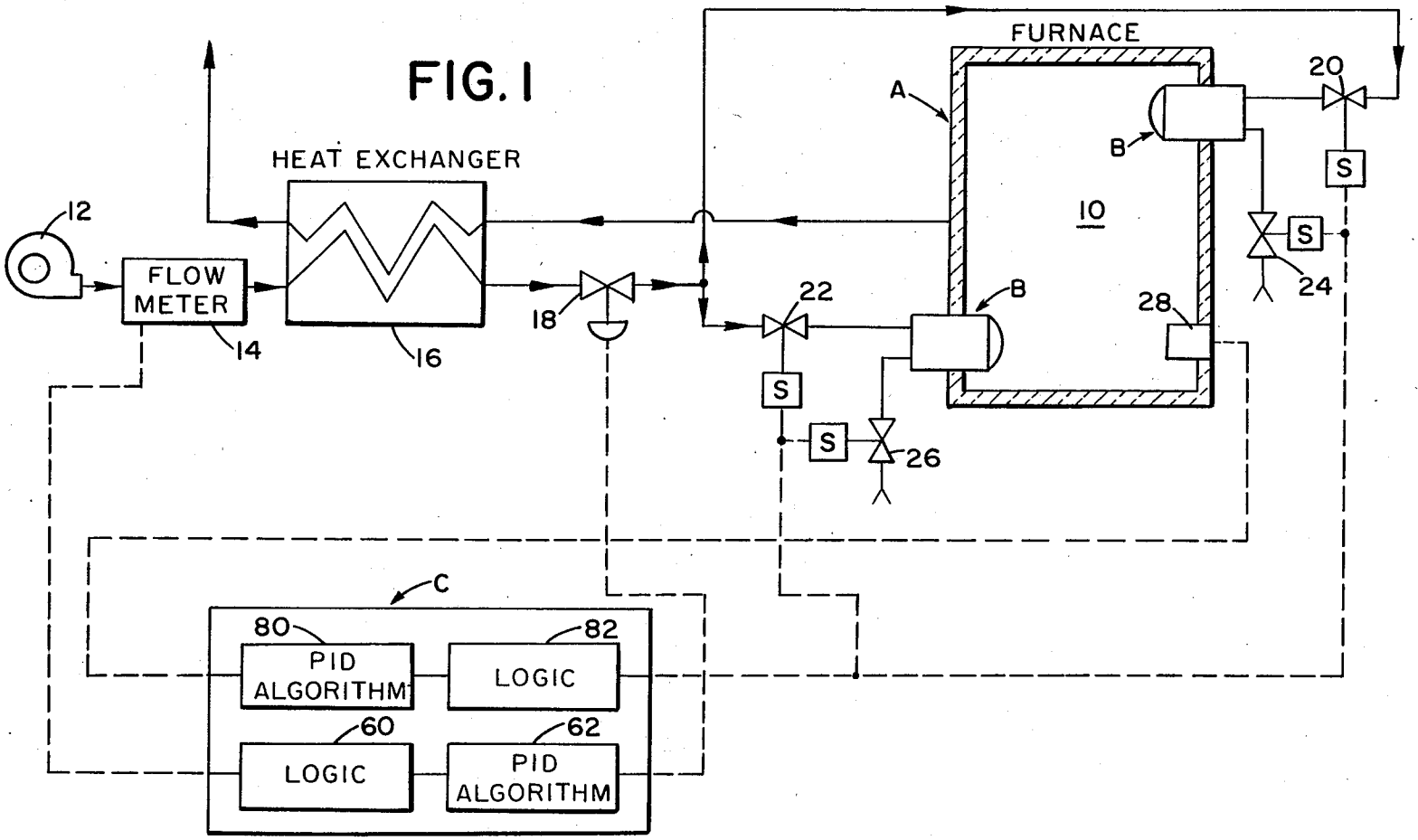
FIG. 1 is a diagrammatic illustration of a combustion apparatus constructed in accordance with the present invention.
Figure 4:
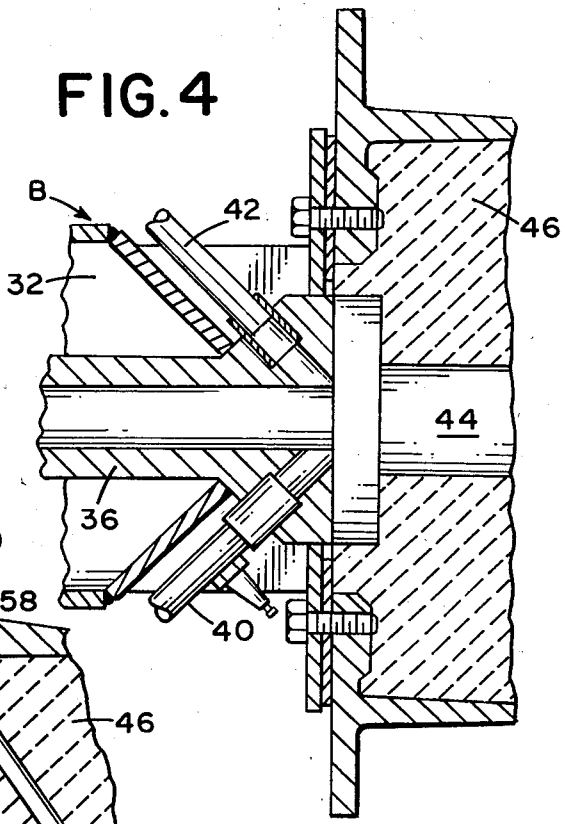
FIG. 4 is an enlarged, cross-sectional view of a first stage combustion area taken along lines 4—4 of FIG. 3.
Figure 5:
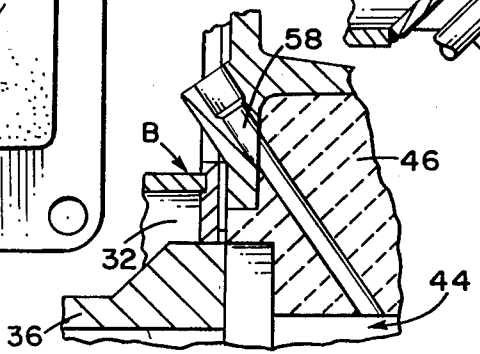
FIG. 5 is an enlarged, cross-sectional view of a sight passage in the burner of FIG. 2.
Figure 2:
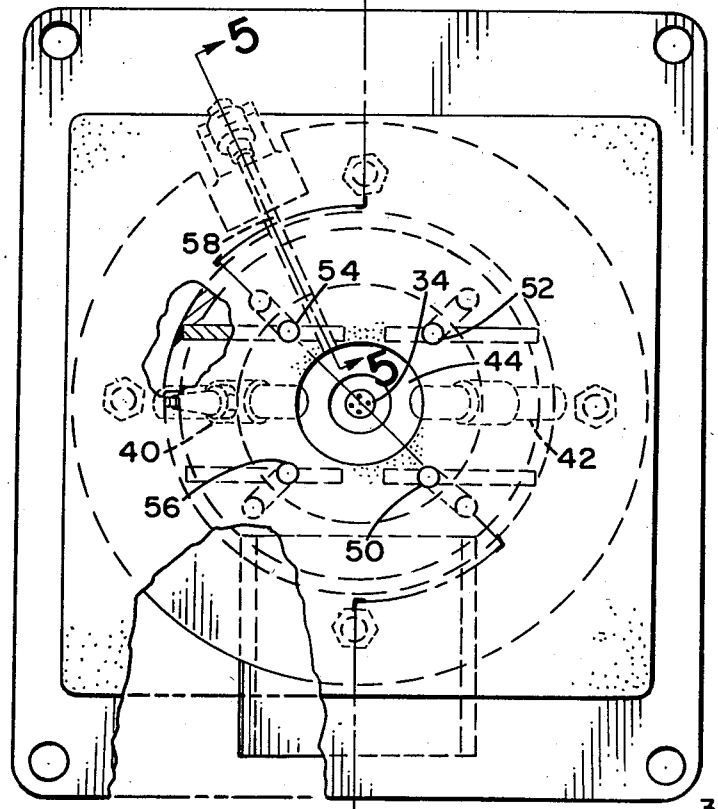
FIG. 2 is an end view in partial section from a combustion chamber of a burner formed in accordance with the invention.
Figure 3:
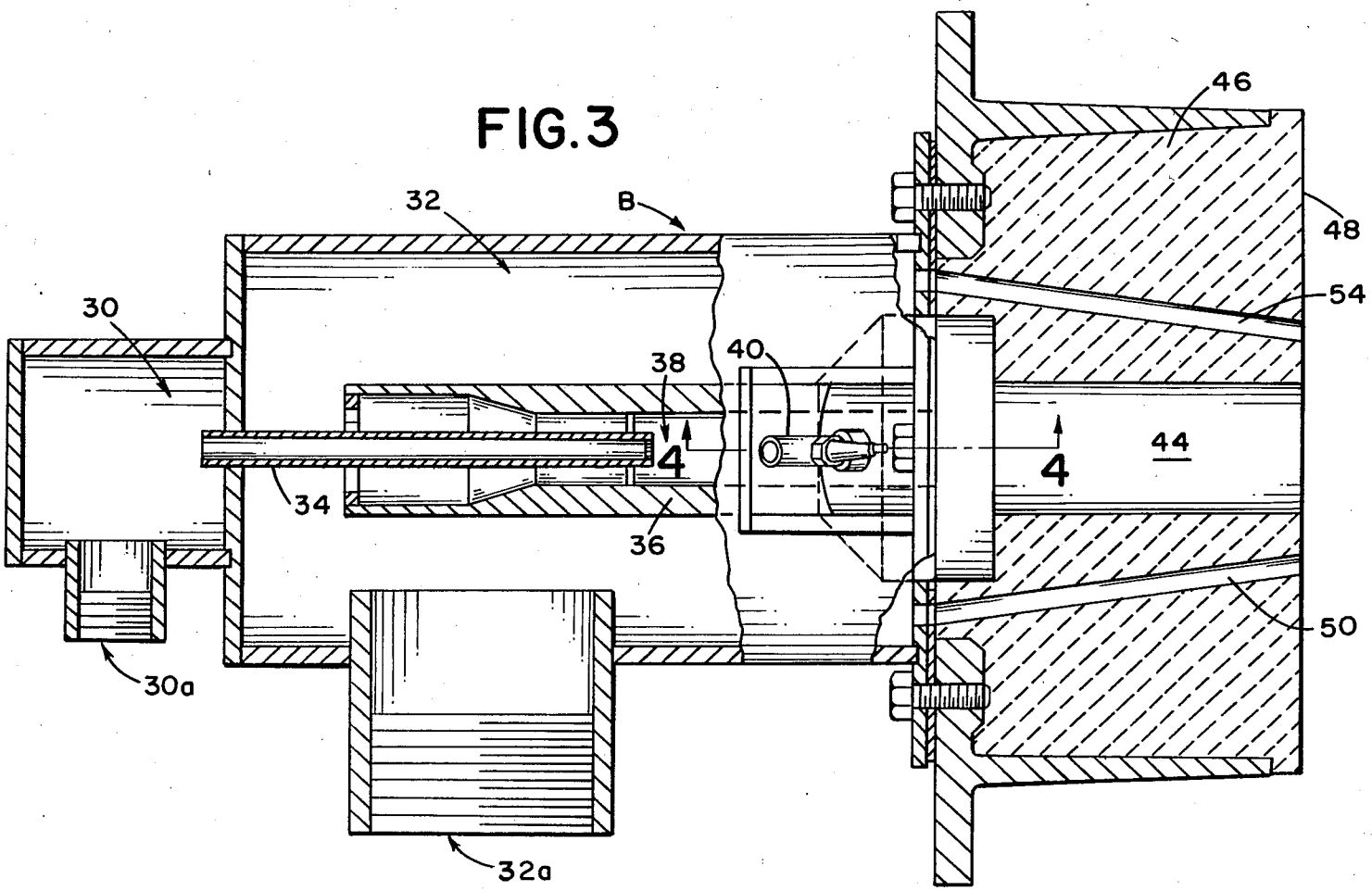
FIG. 3 is a cross-sectional view taken along lines 3—3 of FIG. 2.

Referring now to the drawings wherein the showings are for purposes of illustrating the preferred embodiment of the invention only and not for limiting same, FIG. 1 shows a combustion apparatus A, such as a furnace, which is suitably constructed to hold articles or otherwise define a region to be heated. A plurality of burners B are mounted in the combustion apparatus for oxidizing natural gas or other fuel to heat the combustion chamber, hence the articles to be heated.

A frequency modulated burner control system C controls the temperature by controlling the duty cycle of the burners. That is, the burners are cyclically actuated at a fixed burner rate and deactuated. The actuation to deactuation ratio of each cycle is controlled to vary the thermal input to the combustion apparatus correspondingly. Further, the control means automatically adjusts and controls the air/fuel ratio to maintain the combustion at optimum efficiency. The frequency modulated combustion system finds application in many environments including hardening furnaces, aluminum heat treating, aluminum melting, forging, batch coil heating, ingot heating, slab heating, structural clay product burning, portland cement manufacturing, steel heat treating, copper slab heating, oil pipe heating treating, and the like.

With continued reference to FIG. 1, the combustion apparatus A includes a combustion chamber 10 in which articles to be heated are positionable. An air supply means supplies ambient air at a selectable rate to the burners for combustion. This air supply means includes a blower 12 which pumps ambient air through a flow meter 14 and a heat exchanger 16. Preheated air from the heat exchanger is passed at a selectable rate by an air flow rate adjusting means or valve 18. Air supply solenoid valves 20, 22 each selectively block and permit the flow of air at the selected air flow rate to an associated burner during combustion periods. That is, the air supply solenoid valves alternately enable the burner to receive air at the selected air flow rate and to receive substantially no air flow. Analogously, fuel supply solenoid valves 24, 26 selectively enable and disable the flow of natural gas or other fuel to the burners. A temperature sensing means 28, such as a thermocouple or the like, continuously monitors the temperature in the combustion chamber. Exhaust gases from the combustion chamber pass through the heat exchanger 16 to an exhaust stack. In this manner, heat from the combustion chamber which would otherwise be lost through the exhaust stack is returned to the combustion chamber by preheating the combustion air. Although two burners B are illustrated, it is to be appreciated that the invention is applicable to single burner systems, as well as to systems having more than two burners.

With particular reference to FIGS. 2, 3, 4, and 5, one of burners B will be described, it being appreciated that the other burner is identical thereto unless otherwise specifically noted. As shown, the burner B includes a fuel receiving portion 30 for receiving natural gas or other fuel at inlet 30*a* from the associated solenoid fuel valve, and an air receiving portion 32 for receiving preheated combustion air at inlet 32*a* from the associated air control solenoid valve. A fuel tube 34 communicating with portion 32 and an air tube 36 disposed concentrically around tube 34 in communication with portion 36 channel fuel and air to a mixing chamber or area 38. The fuel and air tubes and the fuel and air supply means are configured and adjusted to provide a fuel rich mixture to the mixing area 38. Optionally, a second tube for carrying an alternate fuel such as fuel oil may be disposed concentric with fuel tube 34 to inject such alternate fuel into the mixing chamber 38.

A pair of pilot gas jets from pilot means 40, 42 provide a continuous ignition means adjacent a downstream end of the mixing area. The fuel rich mixture is ignited by the pilots and partially combusted in a first stage combustion area 44. The first stage combustion area is defined by a refractory member of material 46 which includes a cylindrical passage therethrough. The refractory member or material terminates at a combustion chamber face 48. By providing a straight flow passage to the combustion chamber, combustion momentum is maximized. The combustion of the partially combusted fuel is completed in a second stage combustion area disposed in the combustion chamber adjacent the face 48.

A plurality of air passages 50, 52, 54, and 56 communicate between air receiving portion 32 and the combustion chamber. These passages extend roughly parallel to the flow direction of partially combusted fuel in the first stage combustion area 44 to supply additional preheated air to the second stage combustion area. A sight passage 58 penetrates area 44 from externally of the burner so that an operator can view the first stage combustion area for the presence of flames or other evidence of combustion.

The two-stage combustion provides jet-like combustion with high momentum, i.e., momentum in excess of conventional burners. The high momentum, in turn, injects heat more efficiently into the combustion chamber. Specifically, the high momentum causes turbulence rather than laminar flow, and such turbulence injects and mixes the heat efficiently into the combustion chamber. Further, the two-stage combustion releases the heat in two stages. This prolonged burning of the fuel releases the same number of calories of heat but without attaining as high a combustion temperature. The lower combustion temperature is advantageous in that it inhibits the fuel from cracking and altering its combustion properties. Still further, the lower combustion temperature reduces the formation of nitrogen oxidation by-products ($NO_x$).

Figure 6:
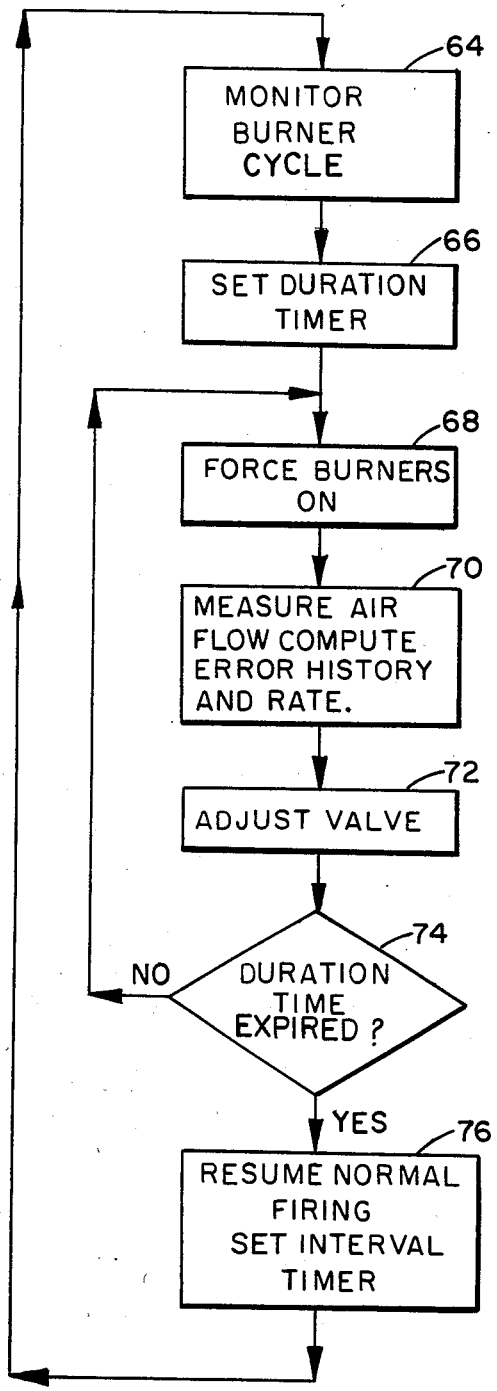
FIG. 6 is a logic flow chart for programming an air/fuel ratio logic control circuit or microcomputer of FIG. 1.

With particular reference to FIGS. 1 and 6, the controller C includes an air-to-fuel ratio adjustment means for adjusting the ratio of the air and fuel supplied to the burner. The air/fuel ratio adjustment means includes a microprocessor or logic means 60 which computes the appropriate rate of air flow and a proportional, integral, differential (PID) algorithm means 62 for converting the selected air flow rate into an appropriate analog control signal for the control valve 18. The air/fuel ratio adjustment microprocessor 60 is programmed in accordance with the programming flow chart of FIG. 6.

In FIG. 6, the air/fuel ratio adjustment processor and program include a step or means 64 for monitoring the burners to determine the beginning of a burner cycle. Calibration duration timing means or step 66 times a calibration duration. The calibration duration timing means or step 66 actuates an override step or means 68 for forcing the burners to the full on condition for the calibration duration. An air flow comparing means 70 compares the air flow measured by the air flow meter 14 with flow rates from a preprogrammed history memory. From the preprogrammed history memory, the comparing means retrieves a preselected flow rate for the present conditions. The air flow rate comparing means compares the measured air supply rate and the historical or theoretically optimal air supply rate to determine the deviation therebetween. A valve adjustment means or step 72 converts this air flow deviation into a control signal for the air flow rate adjusting valve 18. A means or step 74 checks the calibration duration timer 66 to determine whether the calibration duration has expired. If the calibration duration has not expired, steps 68 through 72 are repeated; however, if the calibration duration has expired, a step or means 76 deactivates the air/fuel ratio adjustment means until the next calibration cycle, i.e., once every quarter hour.

Figure 7:
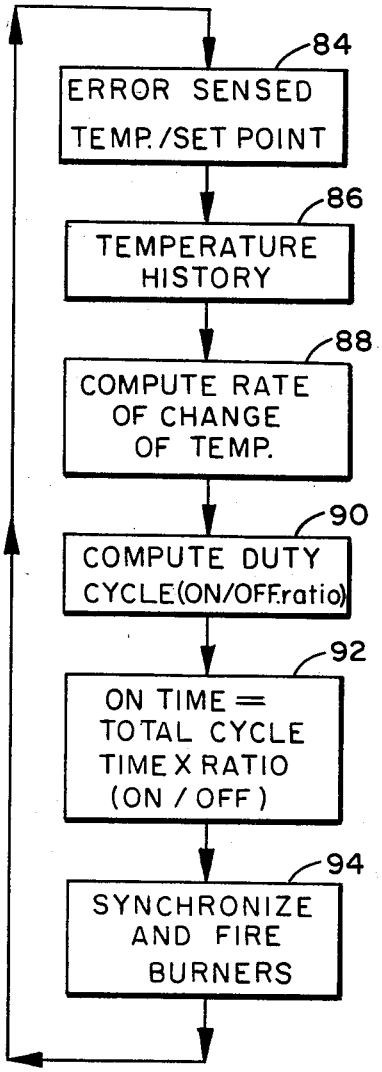
FIG. 7 is a logic flow chart for programming a temperature control logic circuit or microprocessor of FIG. 1.

With reference to FIGS. 1, 7, and 8, the controller C further includes a frequency modulated (FM) burner control system for cyclically actuating the burner at the selected, fixed burn rate and for deactuating the burner, i.e., varying the duty cycle. The FM burner control means includes a proportional, integral, differential (PID) algorithm means 80, and a frequency modulated burner control logic or microprocessor means 82. The proportional, integral, differential algorithm means 80 monitors the temperature of the combustion chamber and provides output signals which are proportional to the temperature, vary with the integral of the temperature, and vary with the derivative of the combustion chamber temperature. That is, the PID algorithm means provides the temperature, the amount of heat energy released into the combustion chamber, and an indication of the rate of change of the temperature. The frequency modulated burner control logic means 82 converts this information into appropriate control signals for the fuel and air solenoid valves 20, 22, 24, and 26. In the preferred embodiment, the logic means 82 comprises a microprocessor which is programmed in accordance with the programming flow chart of FIG. 7.

As shown in FIG. 7, the frequency modulated burner control processor and the program include an error means or step 84 for determining a deviation between the sensed combustion chamber temperature and a selected or set point temperature. A temperature history step or means 86 computes and stores the temperature deviation as a function of time. A rate of change means or step 88 determines the rate of change of the temperature deviation from the temperature data stored in the temperature history means 86. For a fixed set point temperature, the change in temperature deviation is equivalent to the change of the sensed temperature. A duty cycle means or step 90 determines the appropriate on/off ratio of the burners from the temperature deviation and the rate of change history.

For example, the duty cycle means may comprise a two-dimensional look-up table which is addressed by the magnitude of the temperature deviation and the rate of change of the temperature deviation. Each memory cell of the two-dimensional history memory is preprogrammed with appropriate on/off ratio to zero the temperature deviation without substantial overshoot. Optionally, various mathematical algorithms may be implemented to project the convergence of the sensed and set point temperatures. A cycle time means or step 92 converts the on/off ratio to time. That is, the cycle timer means calculates how long the burner is to be actuated in each cycle. A synchronizing step or means 94 synchronizes actuation of the burners.

Figure 8A:
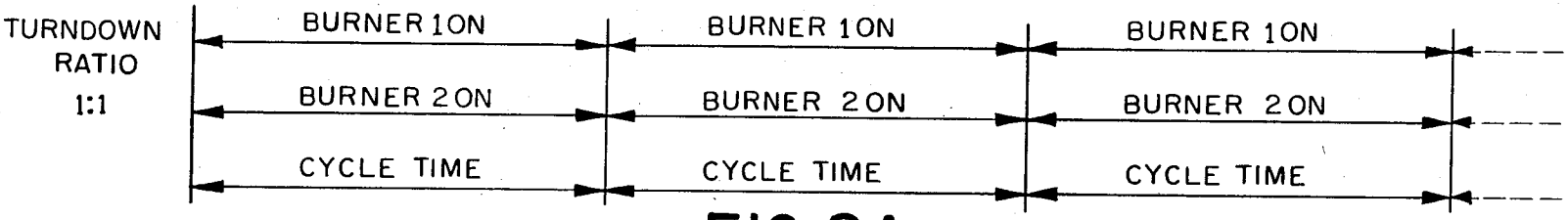
FIGS. 8A, 8B, and 8C illustrate typical burner cycle relationships for a two-burner system; and, FIG. 9 is a diagrammatic illustration of a hard wired embodiment for implementing the logic of FIGS. 6 and 7.
Figure 8B:
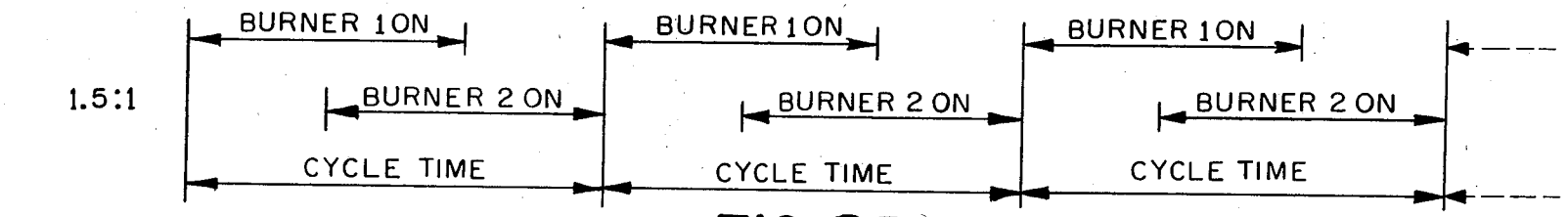
Figure 8C:
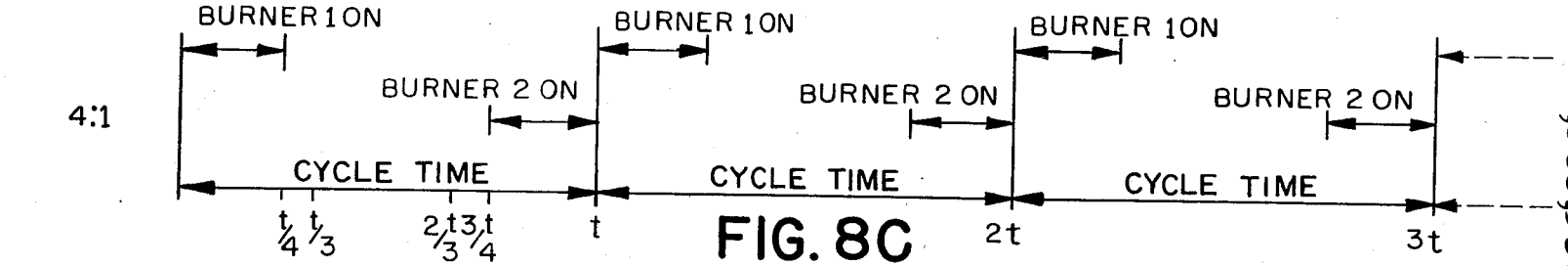

With particular reference to FIGS. 8A, 8B, and 8C, each cycle extends for a duration or cycle time t. The burners are turned on and off once per cycle unless the system is in a maximum heat output mode, i.e., continuously actuated. In the preferred embodiments, each cycle time is in the range of 10 seconds to 2 minutes. However, longer and shorter cycle times are appropriate for some applications. Shorter cycles tend to maintain the combustion chamber temperature constant with greater precision. Longer cycles provide a wider range of duty cycles, i.e., turndown ratios. The cycle time is of sufficient duration to provide a selected range of turndown ratios. In the preferred embodiment, the turndown ratio is at least 10:1 and preferably about 100:1. For some applications larger or smaller turndown ratios may be analogously provided. The maximum turndown rate actuates the burner for a duration which is at least as long as its ignition time. Because the burners tend to be less efficient during ignition than during full combustion, higher efficiency is achieved when the burner is actuated for a duration which is long compared to the ignition time. The burners of the preferred embodiment achieve full, steady state combustion in an ignition time of approximately 0.3 seconds. Thus, with the preferred burners, a cycle time of 30 seconds can provide a 100:1 turndown ratio.

FIGS. 8A, 8B, and 8C illustrate a preferred synchronization schedule for a two-burner system. The maximum heat input condition is illustrated in FIG. 8A. In the mode of FIG. 8A, the first and second burners are each operated for the full cycle time t. In the mode of FIG. 8B, the synchronization means turns each burner on for two-thirds of the cycle period, i.e., a 1.5:1 turndown ratio. Specifically, the first burner is ignited from the beginning of each cycle to two-thirds of the cycle, i.e., 2t/3. Analogously, the second burner is ignited for the last two-thirds of the cycle, i.e., from t/3 to the end of the cycle. This provides an overlap of one-third of the cycle time in the middle of each cycle in which both burners are ignited.

FIG. 8C illustrates the ignition of each burner for a 4:1 turndown ratio. The first burner is ignited from the beginning of each cycle until a quarter of the way into it, i.e., t/4, and the second burner is ignited for the last quarter of the cycle, i.e., from 3t/4 to the end of the cycle. In this manner, one burner is operated at the beginning of each cycle for a selectable firing time and the other is operated at the end of each cycle for the same firing time. Other synchronization schemes also may be satisfactorily utilized. For example, the first and second burners may be operated 180° out of phase such that the first burner ignites at the beginning of a cycle and the second burner ignites at the midpoint of the cycle. With more than two burners, the burners may be divided into two groups or banks and operated as described above. Alternately, with n burners, the burners may be operated 360°/n out of phase. Use of these various alternatives does not, however, in any way depart from the overall intent or scope of invention.

Figure 9:
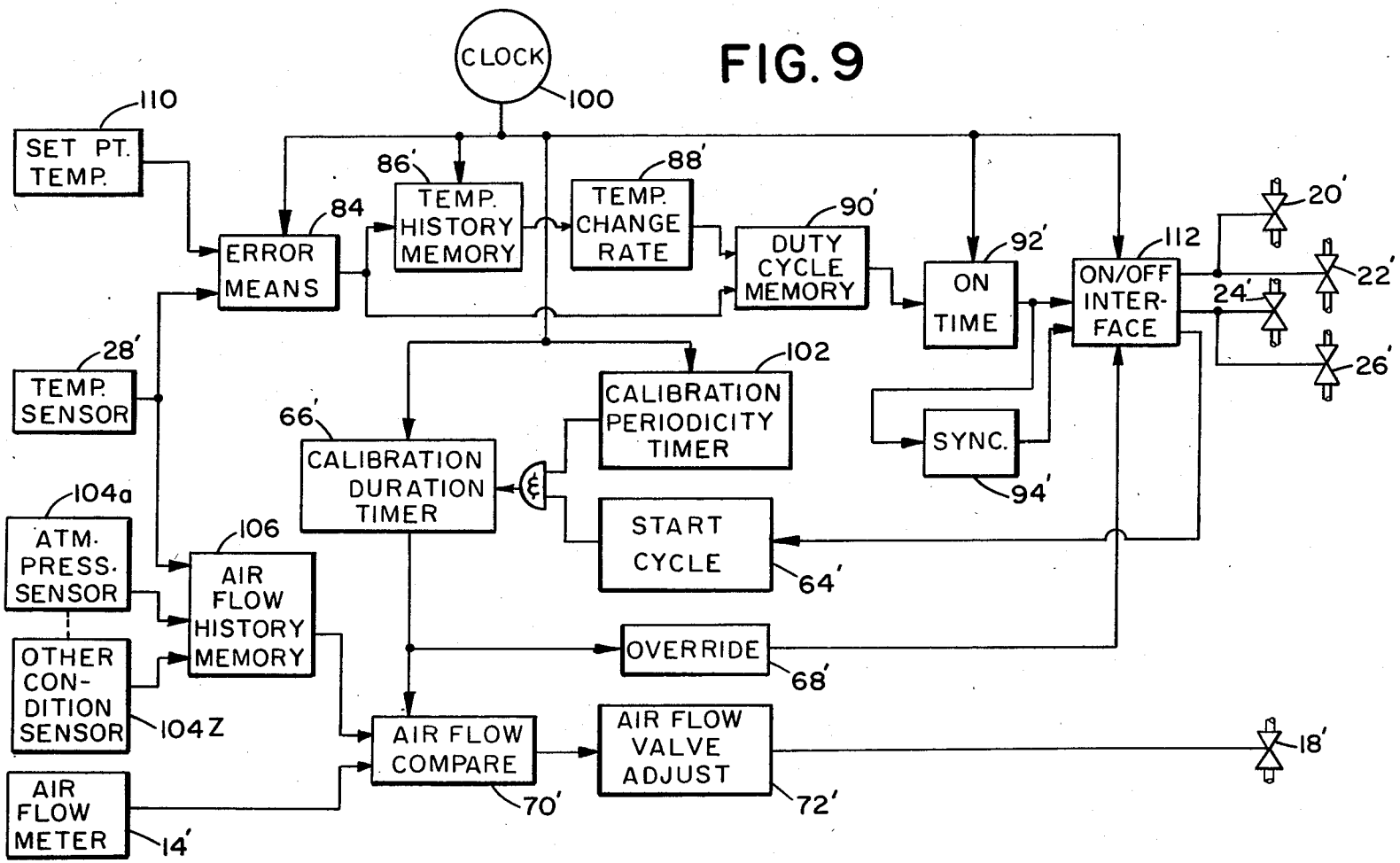

With reference to FIG. 9, an alternate embodiment for implementing the microprocessor control sequence of FIGS. 6 and 7 is illustrated. For ease of illustration and appreciation of this alternative, like components are identified by like reference numerals with a primed (') sufix and new components are identified by new numerals. A system clock 100 provides timing pulses to coordinate circuit elements and to provide timing functions. A calibration periodicity timer 102 periodically determines that a calibration cycle is to occur. A burner cycle monitoring means 64' monitors for the beginning of each burner cycle. A calibration duration timer 66' is enabled by the calibration periodicity timer 102 and start cycle sensor to have an override means 68' cause air and fuel solenoids 20', 22', 24', and 26' to be held open for the calibration duration.

A temperature sensing means 28', an atmospheric pressure sensing means 104*a*, and other air condition sensing means 104*z* sense atmospheric pressure, ambient air temperature, humidity, or other such conditions which reflect upon the oxygen content of the air to be burned. Optionally, sensors may also be provided for sensing variations in the supplied fuel or for sensing variations in combustion by-products. An air flow history memory 106 is addressed with these conditions to retrieve or calculate a selected air flow rate for the sensed conditions. An air flow meter or sensing means 14' senses the air flow into the combustion chamber. An air flow comparing means 70' compares the selected air flow rate for the sensed conditions with the sensed air flow rate and determines a deviation in the air flow rate. An air flow valve adjusting means 72' adjusts an air flow rate controlling valve 18' in accordance with the air flow rate deviation to bring the actual air flow into accord with the selected air flow.

The frequency modulated burner control means includes a set point temperature means 110 on which a selected temperature is set. An error means 84' compares the sensed and set point temperatures to determine a deviation therebetween. A temperature history memory means 86' stores a record of the temperature deviation at each of a plurality of measuring times. A temperature change rate means 88' determines the rate of change of the temperature deviation from the information stored in the temperature history memory means 86'. A two-dimensional duty cycle memory means 90' is indexed by the present temperature change rate and by the present temperature deviation. From these two inputs, a unique memory cell is addressed which indicates a preprogrammed appropriate duty cycle that is calculated to cause the sensed temperature to converge upon the set point temperature. A cycle time means 92' determines the duration which each burner must be actuated within each cycle to accomplish the selected duty cycle. An on/off valve interface means 112 turns the fuel and air control valves 20', 22', 24' and 26' on and off under the control of the cycle time means and a synchronization means 94'. The synchronization means subtracts the on time from the cycle time to determine the actuation time for the second burner, i.e., the burner which is actuated from the variable on time to the end of the cycle.

In normal operation, the heat demand during start-up is high and all burners are fired at full capacity. As the furnace temperature approaches the set point, the demand decreases and the burners are operated at a turndown condition, i.e., a lesser portion of each cycle. During soak periods, the heat demand is also decreased and the burners are operated at a turndown condition. Further, the heat may be varied during the treatment of articles or workpieces in the furnace A. When the heat is increased, the duty cycle is correspondingly increased, and when the heat is decreased, the duty cycle is correspondingly decreased.

The invention has been described with reference to the preferred embodiment. Obviously, modifications and alterations will occur to others upon a reading and understanding of the preceding detailed description. It is intended to include all such modifications and alterations insofar as they come within the scope of the appended claims or the equivalents thereof.

Having thus described the invention, it is now claimed:

1. A combustion apparatus comprising:

a combustion chamber;

at least a first burner operatively communicating with the combustion chamber;

a frequency modulated burner control system for cyclically actuating the burner at a selected, fixed burn rate and deactuating the burner, including:

(i) means for indicating a selected set point combustion chamber temperature;

(ii) means for sensing temperature in the combustion chamber;

(iii) error means for determining a deviation between the selected and sensed temperatures, the error means being operatively connected with the set point means and temperature sensing means; and, (iv) duty cycle adjusting means for adjusting the burner actuation/deactuation ratio, the duty cycle means being operatively connected with the error means for adjusting the burner actuation/deactuation ratio in accordance with the deviation such that the frequency modulated burner control system controls thermal input from the burner.

2. The combustion apparatus as set forth in claim 1 wherein the error means includes:

a rate of temperature change means for determining the rate of change of the sensed temperature, the rate of temperature change means being operatively connected with the temperature sensing means, the duty cycle adjusting means being operatively connected with the rate of temperature change means for adjusting the duty cycle in accordance with the rate of temperature change.

3. A combustion apparatus as set forth in claim 1 further including:

at least one second burner disposed in operative communication with the combustion chamber; and, synchronization means for synchronizing actuation of the first and second burners.

4. The combustion apparatus as set forth in claim 3 wherein the first burner is actuated at the beginning of the cycle and deactuated during the cycle and the second burner is actuated during the cycle and is deactuated at the end of the cycle, whereby actuation of the first and second burners is spread over each cycle.

5. The combustion apparatus as set forth in claim 1 further including:

air supplying means for supplying air to the burner at a selectable air supply rate;

fuel supply means for supplying fuel to the burner at a selectable fuel supply rate; and, air/fuel ratio adjustment means for adjusting a ratio of air and fuel supplied to the burner.

6. The combustion apparatus as set forth in claim 5 wherein the air/fuel ratio adjustment means further includes:

air flow measuring means for measuring the rate at which the air supply means is supplying air to the burner;

air flow comparing means for comparing the measured air supply rate with a desired air supply rate to determine a deviation therebetween, the air flow comparing means being operatively connected with the air flow measuring means; and, air supply rate adjusting means for adjusting the selectable air supply rate in accordance with the deviation between the measured and desired air supply rates, the air supply rate adjusting means being operatively connected with the air flow comparing means.

7. The combustion apparatus as set forth in claim 1 wherein the burner comprises:

a first stage combustion area for partially combusting a fuel rich air/fuel mixture, the first stage combustion area being disposed in fluid communication with the combustion chamber; and, a second stage combustion area disposed downstream from the first stage combustion area for combusting the partially combusted mixture more completely.

8. The combustion apparatus as set forth in claim 7 wherein the burner further includes:

a refractory material having the first stage combustion area therein, a partially combusted gas passage extending from the first stage combustion area to the combustion chamber, and at least one air supply passage which communicates with the second stage combustion area.

9. The combustion apparatus as set forth in claim 8 wherein the partially combusted gas passage extends linearly into the combustion chamber to maximize momentum of the partially combusted mixture and wherein the air supply passage terminates in the combustion chamber adjacent the partially combusted gas passage, the second stage combustion area being disposed in the combustion chamber closely adjacent the refractory material.

10. A method of combusting fuel comprising:

supplying fuel and air to a burner;

cyclically actuating the burner to combust the fuel at a preselected burn rate and deactuating the burner;

varying a duty cycle at which the burner is actuated at the fixed burn rate to vary the amount of heat produced, whereby the heat is controlled by varying a burner actuation/deactuation ratio of each cycle;

sensing a temperature within a combustion chamber;

determining a deviation between the sensed temperature and a selected temperature; and, in the duty cycle varying step, adjusting the duty cycle in accordance with the sensed and selected temperature deviation.

11. The method as set forth in claim 10 further including the steps of:

determining a rate of change of the sensed temperature;

comparing the sensed temperature rate of change with a selected rate of change; and, in the duty cycle varying step, varying the duty cycle in accordance with the rate deviation.

12. A method of combusting fuel comprising:

supplying fuel and air to a burner;

cyclically actuating the burner to combust the fuel at a preselected burn rate and deactuating the burner;

varying a duty cycle at which the burner is actuated at the fixed burn rate to vary the amount of heat produced, whereby the heat is controlled by varying a burner actuation/deactuation ratio of each cycle;

supplying fuel and air to a second burner;

synchronizing actuation of the first and second burners by actuating the first burner at the beginning of each combustion cycle and deactuating the first burner during the cycle; and, actuating the second burner during the cycle and deactuating the second burner at the end of the cycle, whereby actuation of the first and second burners is spread over eacy cycle.

13. A method of combusting fuel comprising:

supplying fuel and air to a burner;

cyclically actuating the burner to combust the fuel at a preselected burn rate and deactuating the burner;

varying a duty cycle at which the burner is actuated at the fixed burn rate to vary the amount of heat produced, whereby the heat is controlled by varying a burner actuation/deactuation ratio of each cycle;

supplying air to the burner at a selected air supply rate;

supplying fuel to the burner at a selected fuel supply rate; and, adjusting a ratio of the air and fuel supplied to the burner.

14. The method as set forth in claim 13 wherein the air/fuel ratio adjusting step includes:

measuring a rate at which air is being supplied to the burner;

comparing the measured air supply rate with a desired air supply rate to determine a deviation therebetween; and, adjusting the air supply rate in accordance with the deviation between the measured and desired air supply rates.

15. A method of combusting fuel comprising:

supplying fuel and air to a burner;

cyclically actuating the burner to combust the fuel at a preselected burn rate and deactuating the burner;

varying a duty cycle at which the burner is actuated at the fixed burn rate to vary the amount of heat produced, whereby the heat is controlled by varying a burner actuation/deactuation ratio of each cycle;

supplying a fuel rich mixture of the air and fuel to a first stage combustion area;

partially combusting the fuel rich mixture in the first stage combustion area; and, further combusting the partially combusted air and fuel mixture downstream from the first stage combustion area, whereby a two-stage combustion of the fuel is provided.

16. The method as set forth in claim 15 further including the step of preheating combustion air with exhaust gases.

17. The method as set forth in claim 15 wherein the plurality combusted fuel rich mixture is impelled by the combustion along a substantially linear path from the first stage combustion area and wherein the further combusting step includes introducing a supply of air adjacent to the linear path such that the two combustion stages each increase combustion momentum.

18. A combustion apparatus comprising:

a combustion chamber;

at least a first burner operatively communicating with the combustion chamber;

a frequency modulated burner control system for cyclically actuating the burner at a selected, fixed burn rate and deactuating the burner such that the frequency modulated burner control system controls thermal input from the burner by controlling an actuation to deactuation ratio of each cycle;

means for supplying air to the burner at a selectable air supply rate;

means for supplying fuel to the burner at a selectable fuel supply rate;

means for adjusting a ratio of air and fuel supplied to the burner, including:

(i) means for measuring the flow rate at which the air supply means is supplying air to the burner;

(ii) means for comparing the measured air supply flow rate with a desired air supply rate to determine a deviation therebetween, the air flow comparing means being operatively connected with the air flow measuring means;

(iii) means for adjusting the selectable air supply rate in accordance with the deviation between the measured and desired air supply rates, the air supply rate adjusting means being operatively connected with the air flow comparing means; and, means for periodically overriding the burner control system to cause the burner to be actuated for a calibration duration without regard to the combustion chamber temperature, the air supply rate adjusting means being operatively connected with the air/fuel ratio adjustment means to adjust the air/fuel ratio during the overriding.

19. A method of combusting fuel comprising:

supplying air to the burner at a selected air supply rate;

supplying fuel to the burner at a selected fuel supply rate;

cyclically actuating a burner to combust the fuel at a preselected burn rate and deactuating the burner;

varying a duty cycle at which the burner is actuated at the fixed burn rate to vary the amount of heat produced, whereby the heat is controlled by varying a burner actuation/deactuation ratio of each cycle;

adjusting a ratio of the air and fuel supplied to the burner;

mesuring a rate at which air is being supplied to the burner;

comparing the measured air supply rate with a desired air supply rate to determine a deviation therebetween;

adjusting the air supply rate in accordance with the deviation between the measured and desired air supply rates;

causing the burner to be actuated for a calibration duration of sufficient length to reach a steady state combustion condition without regard to the sensed temperature; and, performing the air flow measuring step during the calibration duration such that the air supply rate is adjusted in accordance with the rate deviation measured during the steady state combustion condition.

* * * * *